US009972283B2

(12) United States Patent
Zhao

(10) Patent No.: US 9,972,283 B2
(45) Date of Patent: May 15, 2018

(54) SCANNING DRIVING CIRCUITS AND THE FLAT DISPLAY DEVICE HAVING THE SAME

(71) Applicant: Wuhan China Star Optoelectronics Technology Co., Ltd., Wuhan, Hubei (CN)

(72) Inventor: Mang Zhao, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 213 days.

(21) Appl. No.: 15/024,075

(22) PCT Filed: Feb. 22, 2016

(86) PCT No.: PCT/CN2016/074226

§ 371 (c)(1),
(2) Date: Mar. 23, 2016

(87) PCT Pub. No.: WO2017/128458

PCT Pub. Date: Aug. 3, 2017

(65) Prior Publication Data

US 2018/0040299 A1 Feb. 8, 2018

(30) Foreign Application Priority Data

Jan. 25, 2016 (CN) ..... 2016 1 0049516

(51) Int. Cl.
*G09G 3/3266* (2016.01)
*G09G 5/18* (2006.01)

(52) U.S. Cl.
CPC ..... *G09G 5/18* (2013.01)

(58) Field of Classification Search
CPC ..... G09G 3/3677; G09G 2310/08; G09G 2310/061; G09G 2300/0426; G09G 2300/0408; G09G 2310/0251; H01L 27/124
See application file for complete search history.

(56) References Cited

U.S. PATENT DOCUMENTS

2016/0189586 A1* 6/2016 Zou ..... G09G 3/3266 345/213

FOREIGN PATENT DOCUMENTS

JP 2014191848 A 10/2014
KR 20150136194 A 5/2014

* cited by examiner

*Primary Examiner* — Premal R Patel
(74) *Attorney, Agent, or Firm* — Andrew C. Cheng

(57) ABSTRACT

The present disclosure relates to scanning driving circuit and flat display device. A pull-up maintaining module receives clock signals at the previous level, to charge a pull-up control signal node and pull up a pull-down control signal node; a control module receives pull-up control signals at the previous level and scanning driving signals at the previous level, and control the pull-up maintaining module; an output module connects to the pull-up maintaining module and the control module for outputting the scanning driving signals to scanning lines; the scanning lines transmits the scanning driving signals to pixel cells.

16 Claims, 8 Drawing Sheets

SCANNING DRIVING CIRCUITS AND THE FLAT DISPLAY DEVICE HAVING THE SAME

BACKGROUND OF THE INVENTION

1. Field of the Invention

The present disclosure relates to display technology, and more particularly to a scanning driving circuit and the flat display device having the same.

2. Discussion of the Related Art

Usually, flat display devices adopt GOA, wherein non-normal disturbance may be inputted to the scanning driving circuit at the next level via controlled clock signals. As such, the operations of the scanning driving circuit at the next level may be affected. That is, the normal display of panels may be affected, and so does the stability of the scanning driving circuit.

SUMMARY

The present disclosure relates to a scanning driving circuit and the flat display device having the same to guarantee the stability of the scanning driving circuit.

In one aspect, a scanning driving circuit includes: a pull-up maintaining module is configured for receiving clock signals at the previous level, and is configured for charging a pull-up control signal node by pulling up a pull-down control signal node in accordance with the clock signals from the previous level; a control module connects to the pull-up maintaining module for receiving pull-up control signals at the previous level and scanning driving signals at the previous level, and is configured for controlling the pull-up maintaining module in accordance with the pull-up control signals at the previous level and the scanning driving signals at the previous level; an output module connects to the pull-up maintaining module and the control module for outputting the scanning driving signals to the scanning lines; and scanning lines for transmitting the scanning driving signals to pixel cells.

Wherein the scanning driving circuit further includes: a forward-backward scanning module for outputting forward scanning driving signals and backward scanning driving signals to drive the scanning driving circuit; an input module connecting between the forward-backward scanning module and the control module, the input module is configured for receiving first next-level clock signals, and is configured for charging the pull-up control signal node by the received first next-level clock signals; and a processing module connecting the control module and the pull-up maintaining module, the processing module is configured for receiving the pull-up control signals at the previous level, and is configured for controlling the pull-up maintaining module in accordance with the pull-up control signals at the previous level.

Wherein the control module includes a first controllable transistor, an input end of the first controllable transistor connects to the scanning driving signals at the previous level, a control end of the first controllable transistor connects to the pull-up control signals at the previous level, and an output end of the first controllable transistor connects to the pull-up maintaining module.

wherein the pull-up maintaining module includes a second controllable transistor, a third controllable transistor, a fourth controllable transistor, a fifth controllable transistor, and a first capacitor, an output end of the second controllable transistor connects to the output end of the first controllable transistor and a control end of the third controllable transistor, and a control end of the second controllable transistor connects to a control end of the fifth controllable transistor and an output end of the third controllable transistor, the input ends of the second controllable transistor, the third controllable transistor, and the fifth controllable transistor connect to a turn-on voltage end, the output end of the fifth controllable transistor connects to one scanning line and the output module, one end of the first capacitor connects to the input end of the fifth controllable transistor, and the other end of the first capacitor connects to the control end of the fifth controllable transistor, a control end of the fourth controllable transistor connects to the clock signals at the previous level, an input end of the fourth controllable transistor connects to the turn-off voltage end, and an output end of the fourth controllable transistor connects to the output end of the third controllable transistor.

Wherein the output module includes a sixth controllable transistor and a second capacitor, a control end of the sixth eleventh transistor connects to a first end of the second capacitor, and a second end of the second capacitor connects to the output end of the fifth controllable transistor, the scanning line, and an output end of the sixth eleventh transistor, and an input end of the sixth eleventh transistor connects to the clock signals at the current level.

Wherein the scanning driving circuit includes a voltage regulator module for regulating the voltage and for preventing the pull-up maintaining module from leaking electricity, the voltage regulator module includes a seventh controllable transistor, a control end of the seventh controllable transistor connects to the input end of the fourth controllable transistor and to turn-off voltage end, an input end of the seventh controllable transistor connects to the output end of the second controllable transistor, the output end of the first controllable transistor, and the control end of the third controllable transistor, and an output end of the seventh controllable transistor connects to the control end of the sixth eleventh transistor and the first end of the second capacitor.

Wherein the scanning driving circuit further includes a pull-up auxiliary module for avoiding electrical leakage when the pull-up maintaining module charges the pull-up control signal node of the output module, the pull-up auxiliary module includes an eighth controllable transistor, a control end of the eighth controllable transistor connects to the input end of the first controllable transistor, an input end of the eighth controllable transistor connects to the input end of the second controllable transistor, the input end of the third controllable transistor, the input end of the fifth controllable transistor, and the turn-on voltage end, and an output end of the eighth controllable transistor connects to the control end of the second controllable transistor.

Wherein the forward-backward scanning module includes a ninth controllable transistor, a tenth controllable transistor, an eleventh controllable transistor, and a twelfth controllable transistor, a control end of the ninth controllable transistor connects to a first scanning control voltage, an input end of the ninth controllable transistor connects to the scanning driving signals at the next level, and an output end of the ninth controllable transistor connects to the input module, a control end of the tenth controllable transistor connects to a second scanning control voltage, an input end of the tenth controllable transistor connects to the scanning driving signals at the previous level, and an output end of the tenth controllable transistor connects to the output end of the ninth controllable transistor, a control end of the eleventh controllable transistor connects to the first scanning control voltage, an input end of the eleventh controllable transistor connects to third next-level clock signals, and an output end of the eleventh controllable transistor connects to the pull-up maintaining module, a control end of the twelfth controllable transistor connects to the second scanning control voltage, an input end of the twelfth controllable transistor connects to the second next-level clock signals, and an output end of the twelfth controllable transistor connects to the output end of the eleventh controllable transistor; and the input module includes a thirteenth controllable transistor, a control end of the thirteenth controllable transistor connects to the first next-level clock signals, an input end of the thirteenth controllable transistor connects to the output end of the first controllable transistor, and an output end of the thirteenth controllable transistor connects to the input end of the first controllable transistor of the control module; and the processing module includes a fourteenth controllable transistor, a control end of the fourteenth controllable transistor connects to the pull-up control signals at the next level, an input end of the fourteenth controllable transistor connects to the input end of the first controllable transistor, and an output end of the fourteenth controllable transistor connects to the output end of the first controllable transistor and the output end of the second controllable transistor.

Wherein the first through the fourteenth transistors are NMOS TFTs.

In another aspect, a flat display device includes any one of the above scanning driving circuits.

The scanning driving circuit controls the transfer of the scanning signals by the pull-up control signals Q(N−1) at the previous level and the pull-up control signals Q(N+1) at the next level to prevent the scanning driving circuit from being charged repeatedly during the non-operational period. In this way, the stability of the scanning driving circuit may be greatly enhanced.

DETAILED DESCRIPTION OF THE EMBODIMENTS

Embodiments of the invention will now be described more fully hereinafter with reference to the accompanying drawings, in which embodiments of the invention are shown.

Figure 1:
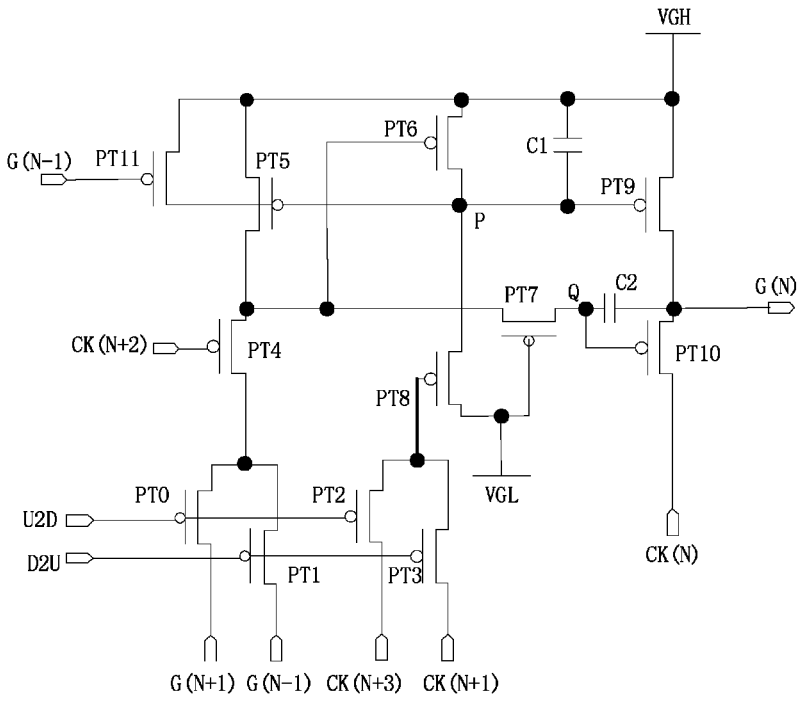
FIG 1(Prior Art)
FIG. 1 is a circuit diagram of one conventional scanning driving circuit.
Figure 2:
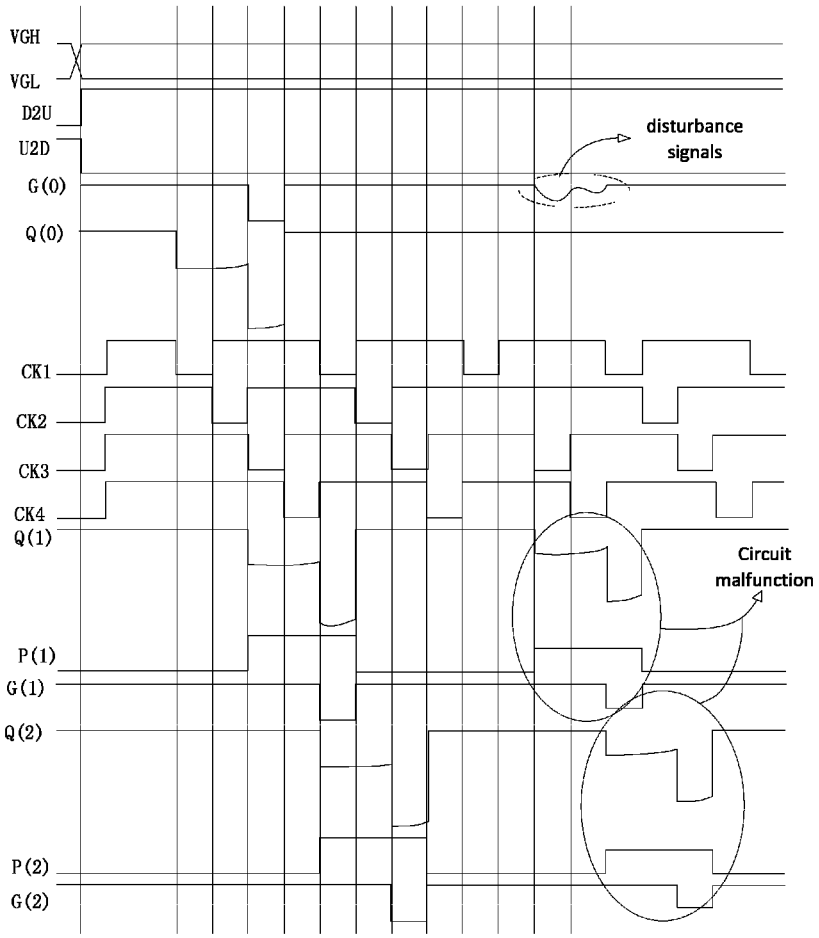
FIG 2(Prior Art)
FIG. 2 is a waveform diagram of the conventional scanning driving circuit.

Referring to FIGS. 1 and 2, as shown in FIG. 1, the power consumption of the circuit is larger during the non-operational period. With respect to the circuit in FIG. 1, after the scanning driving signals are generated, the transistor (PT4) controlled by the clock signals CK(N+2) at the next level is still in the operational period. During the non-operational period, the scanning driving circuit writes the scanning driving signals G(N−1) at the previous level to the pull-up control signals Q(N) at the current level via the transition of the clock signals CK(N+2) at the next level. Although the pull-up control signals Q(N−1) at the previous level maintain at the low level, but the turned on and off transistor (PT4) may cause additional power consumption and non-ideal operational states. In view of FIG. 2, it can be conceived the conventional scanning driving circuit has one issue, which may directly cause the malfunction of the circuit. When the level signals are affected by external conditions, the transmitted waveform may change. Such disturbance may be inputted to the pull-up control signals Q(N) at the current level via controlling the clock signals CK(N+2) at the next level, such that the operations of the scanning driving circuit at the next level may be affected, and so does the normal display of the panel.

Figure 3:
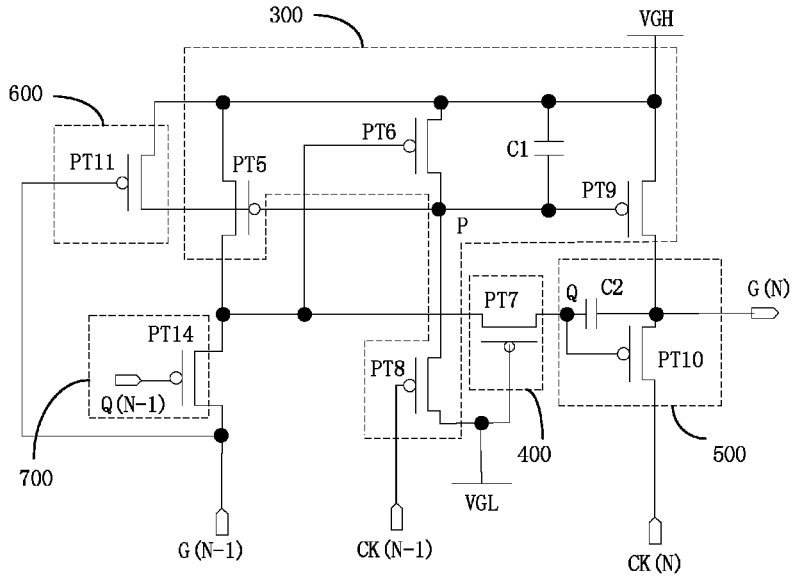
FIG. 3 is a schematic view of the scanning driving circuit in accordance with a first embodiment.

FIG. 3 is a schematic view of the scanning driving circuit in accordance with a first embodiment. As shown in FIG. 3, the pull-up maintaining module 300 is configured for receiving the clock signals CK(N−1) at the previous level, and is configured for pulling up the pull-down control signal node (P) and for charging a pull-up control signal node (Q) in accordance with the received clock signals CK(N−1) at the previous level.

The control module 700 connects to the pull-up maintaining module 300 for receiving the pull-up control signals Q(N−1) at the previous level and the scanning driving signals G(N−1) at the previous level, and is configured for controlling the pull-up maintaining module 300 in accordance with the pull-up control signals Q(N−1) at the previous level and the scanning driving signals G(N−1) at the previous level. An output module 500 connects to the pull-up maintaining module 300 and the control module 700 for outputting the scanning driving signals to the scanning lines. The scanning lines are configured for transmitting the scanning driving signals to the pixel cell.

The control module 700 includes a first controllable transistor (PT14). An input end of the first controllable transistor (PT14) connects to the scanning driving signals G(N−1) at the previous level, a control end of the first controllable transistor (PT14) connects to the pull-up control signals Q(N−1) at the previous level, and an output end of the first controllable transistor (PT14) connects to the pull-up maintaining module 300.

The pull-up maintaining module 300 includes a second controllable transistor (PT5), a third controllable transistor (PT6), a fourth controllable transistor (PT8), a fifth controllable transistor (PT9), and a first capacitor (C1). An output end of the second controllable transistor (PT5) connects to the output end of the first controllable transistor (PT14) and the control end of the third controllable transistor (PT6), a control end of the second controllable transistor (PT5) connects to the control end of the fifth controllable transistor (PT9) and the output end of the third controllable transistor (PT6). The input ends of the second controllable transistor (PT5), the third controllable transistor (PT6), and the fifth controllable transistor (PT9) connects to the turn-on voltage end (VGH). The output end of the fifth controllable transistor (PT9) connects to one scanning line and the output module 500. One end of the first capacitor (C1) connects to the input end of the fifth controllable transistor (PT9), and the other end of the first capacitor (C1) connects to the control end of the fifth controllable transistor (PT9). The control end of the fourth controllable transistor (PT8) connects to the clock signals CK(N−1) at the previous level. The input end of the fourth controllable transistor (PT8) connects to the turn-off voltage end (VGL). The output end of the fourth controllable transistor (PT8) connects to the output end of the third controllable transistor (PT6).

The output module 500 includes the sixth controllable transistor (PT10) and a second capacitor (C2). The control end of the sixth eleventh transistor (PT10) connects to a first end of the second capacitor (C2), and a second end of the second capacitor (C2) connects to the output end of the fifth controllable transistor (PT9), the scanning line, and the output end of the sixth eleventh transistor (PT10). The input end of the sixth eleventh transistor (PT10) connects to the clock signals CK(N) at the current level.

The scanning driving circuit includes a voltage regulator module 400 for regulating the voltage and for preventing the pull-up maintaining module 300 from leaking the electricity. The voltage regulator module 400 includes a seventh controllable transistor (PT7). The control end of the seventh controllable transistor (PT7) connects to the input end of the fourth controllable transistor (PT8) and to the turn-off voltage end (VGL). The input end of the seventh controllable transistor (PT7) connects to the output end of the second controllable transistor (PT5), the output end of the first controllable transistor (PT14), and the control end of the third controllable transistor (PT6). The output end of the seventh controllable transistor (PT7) connects to the control end of the sixth eleventh transistor (PT10) and the first end of the second capacitor (C2).

The scanning driving circuit further includes a pull-up auxiliary module 600 for avoiding the electrical leakage when the pull-up maintaining module 300 charges the pull-up control signal node (Q) of the output module 500. The pull-up auxiliary module 600 includes an eighth controllable transistor (PT11). The control end of the eighth controllable transistor (PT11) connects to the input end of the first controllable transistor (PT14). The input end of the eighth controllable transistor (PT11) connects to the input end of the second controllable transistor (PT5), the input end of the third controllable transistor (PT6), the input end of the fifth controllable transistor (PT9), and the turn-on voltage end (VGH). The output end of the eighth controllable transistor (PT11) connects to the control end of the second controllable transistor (PT5).

In the first embodiment, the first through the eight controllable transistors (PT14, PT5, PT6, PT8-PT10, PT7, and PT11) are PMOS TFTs.

In the first embodiment, the scanning driving circuit controls the transmission of the scanning driving signals G(N−1) at the previous level by the pull-up control signals Q(N−1) at the previous level. In this way, the loading of the clock signals (CK) may be reduced without affecting the operations of the scanning driving circuit, and the power consumption of the scanning driving circuit may also be reduced. In one embodiment, the scanning driving circuit may be a forward-scanning circuit or a backward-scanning circuit.

Figure 4:
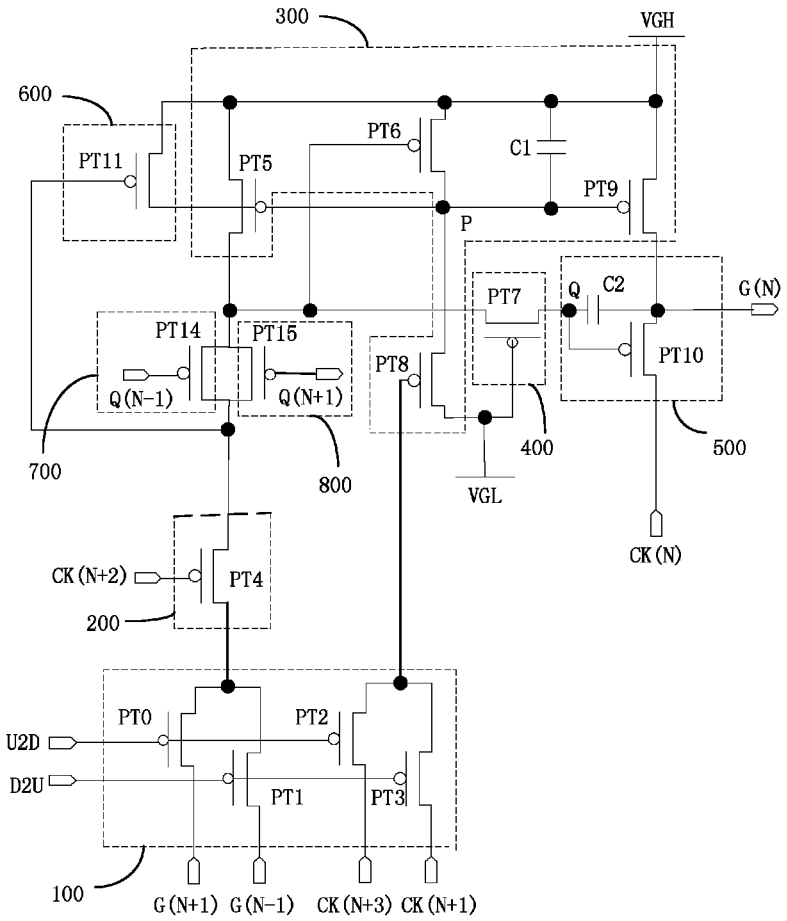
FIG. 4 is a schematic view of the scanning driving circuit in accordance with a second embodiment.

FIG. 4 is a schematic view of the scanning driving circuit in accordance with a second embodiment. As shown in FIG. 4, the difference between the scanning driving circuits in the first and the second embodiments reside in that: the scanning driving circuit further includes: a forward-backward scanning module 100 for outputting forward scanning driving signals and backward scanning driving signals to drive the scanning driving circuit; an input module 200 connecting between the forward-backward scanning module 100 and the control module 700. The input module 200 is configured for receiving the first next-level clock signals CK(N+2), and is configured for charging the pull-up control signal node (Q) by the received first next-level clock signals CK(N+2). The scanning driving circuit further includes a processing module 800 connecting the control module 700 and the pull-up maintaining module 300. The processing module 800 is configured for receiving the pull-up control signals Q(N+1) at the previous level, and is configured for controlling the pull-up maintaining module 300 in accordance with the pull-up control signals Q(N−1) at the previous level.

The forward-backward scanning module 100 further includes a ninth controllable transistor (PT0), a tenth controllable transistor (PT1), an eleventh controllable transistor (PT2), and a twelfth controllable transistor (PT3). The control end of the ninth controllable transistor (PT0) connects to a first scanning control voltage (U2D), an input end of the ninth controllable transistor (PT0) connects to the scanning driving signals G(N+1) at the next level, and the output end of the ninth controllable transistor (PT0) connects to the input module 200. The control end of the tenth controllable transistor (PT1) connects to a second scanning control voltage (D2U). The input end of the tenth controllable transistor (PT1) connects to the scanning driving signals G(N−1) at the previous level, and the output end of the tenth controllable transistor (PT1) connects to the output end of the ninth controllable transistor (PT0). A control end of the eleventh controllable transistor (PT2) connects to the first scanning control voltage (U2D), an input end of the eleventh controllable transistor (PT2) connects to third next-level clock signals CK(N+3), and an output end of the eleventh controllable transistor (PT2) connects to the pull-up maintaining module 300. The control end of the twelfth controllable transistor (PT3) connects to the second scanning control voltage (D2U), the input end of the twelfth controllable transistor (PT3) connects to the second next-level clock signals CK(N+1), and the output end of the twelfth controllable transistor (PT3) connects to the output end of the eleventh controllable transistor (PT2).

The input module 200 includes a thirteenth controllable transistor (PT4). A control end of the thirteenth controllable transistor (PT4) connects to the first next-level clock signals CK(N+2), an input end of the thirteenth controllable transistor (PT4) connects to the output end of the first controllable transistor (PT0), and an output end of the thirteenth controllable transistor (PT4) connects to the input end of the first controllable transistor (PT14) of the control module 700.

The processing module 800 includes a fourteenth controllable transistor (PT15). A control end of the fourteenth controllable transistor (PT15) connects to the pull-up control signals Q(N+1) at the next level, an input end of the fourteenth controllable transistor (PT15) connects to the input end of the first controllable transistor (PT14), and an output end of the fourteenth controllable transistor (PT15) connects to the output end of the first controllable transistor (PT14) and the output end of the second controllable transistor (PT5).

In the second embodiment, the first through the fourteenth transistors (PT14, PT5, PT6, PT8-PT10, PT11, PT0-PT4, and PT15) are PMOS TFTs.

In the second embodiment, the scanning driving circuit 1 does not control the pull-down control signal node (P) via the scanning driving signals G(N−1) at the previous level. Instead, the liquid crystal panel 1 pulls up the pull-down control signal node (P) by the scanning driving signals G(N−1) at the previous level and the scanning driving signals G(N+1) at the next level selected by the forward-backward scanning module 100. In this way, the scanning driving circuit is prevented from being failed during the backward-scanning period.

Figure 5:
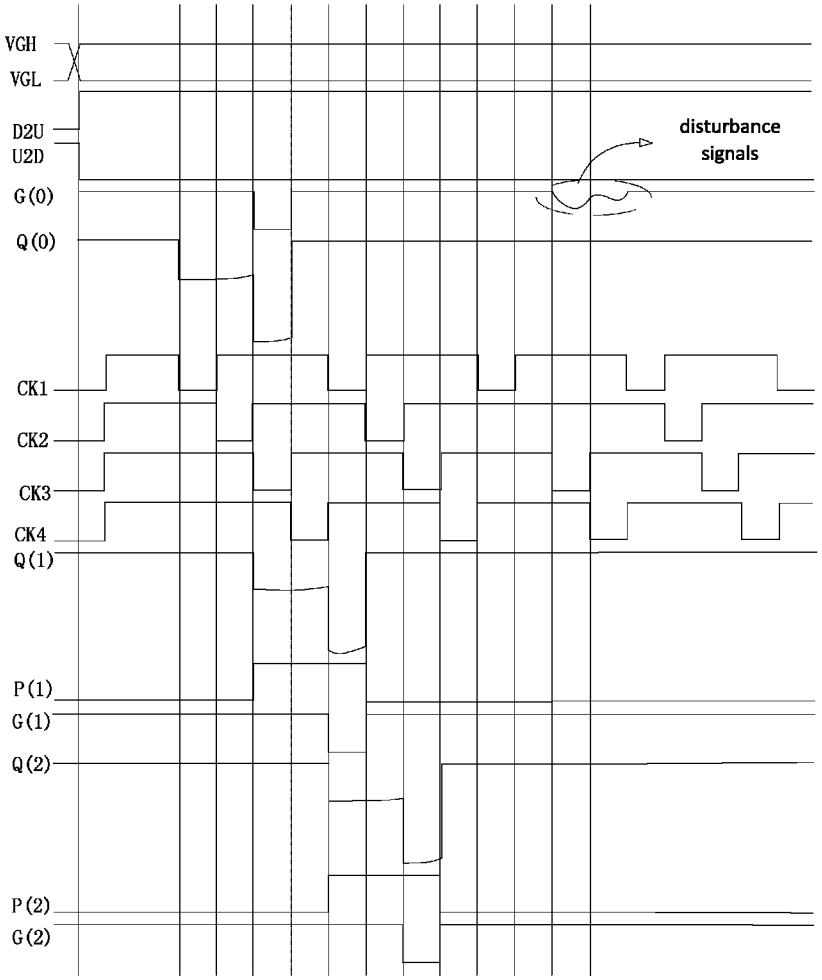
FIG. 5 is a waveform diagram of the scanning driving circuit in accordance with one embodiment.

FIG. 5 is a waveform diagram of the scanning driving circuit in accordance with one embodiment. The operational principles of the scanning driving circuit of FIG. 5 will be described hereinafter. When the scanning driving signals G(N−1) at the previous level show up, the tenth controllable transistor (PT1), the thirteenth controllable transistor (PT4), and the first controllable transistor (PT14) are turned on. At this moment, the pull-up control signal node (Q) at the current level is charged to be at the low level. The pull-down control signal node (P) at the current is charged to be at the high level. When the scanning driving signals G(N−1) at the previous level end, the thirteenth controllable transistor (PT4) and the first controllable transistor (PT14) are turned off. At this moment, the pull-up control signals Q(N) at the current level is maintained to be at the low level, and the pull-down control signal node (P) at the current level is maintained to be at the high level. When the clock signals CK(N) at the current level show up, the scanning driving signals G(N) at the current level are outputted. When the scanning driving signals G(N) at the current level are outputted completely, along with the clock signals CK(N+1) at the previous level, the pull-down control signal node (P) at the current level is pulled down to be at the low level, and the pull-up control signals Q(N) at the current level transits to the high level, and the scanning driving signals G(N) at the current level maintains at the high level. When the pull-up control signals Q(N−1) at the previous level and the pull-up control signals Q(N+1) at the next level stably output the high level, the first controllable transistor (PT14) and the fourteenth controllable transistor (PT15) are in the off state. At this moment, the fluctuation of the scanning driving signals G(N−1) at the previous level may not affect the pull-up control signal node (Q) at the current level such that the scanning driving circuit is in a stable state.

Figure 6:
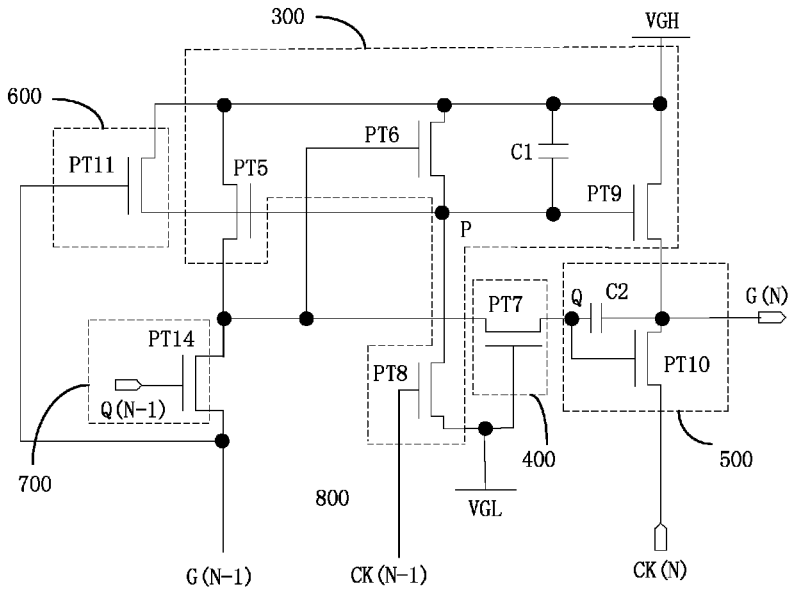
FIG. 6 is a schematic view of the scanning driving circuit in accordance with a third embodiment.

FIG. 6 is a schematic view of the scanning driving circuit in accordance with a third embodiment. The difference between this embodiment and the first embodiment resides in that: the first through the eighth controllable transistors (PT14, PT5, PT6, PT8-PT10, PT7, and PT11) are NMOS TFTs.

Figure 7:
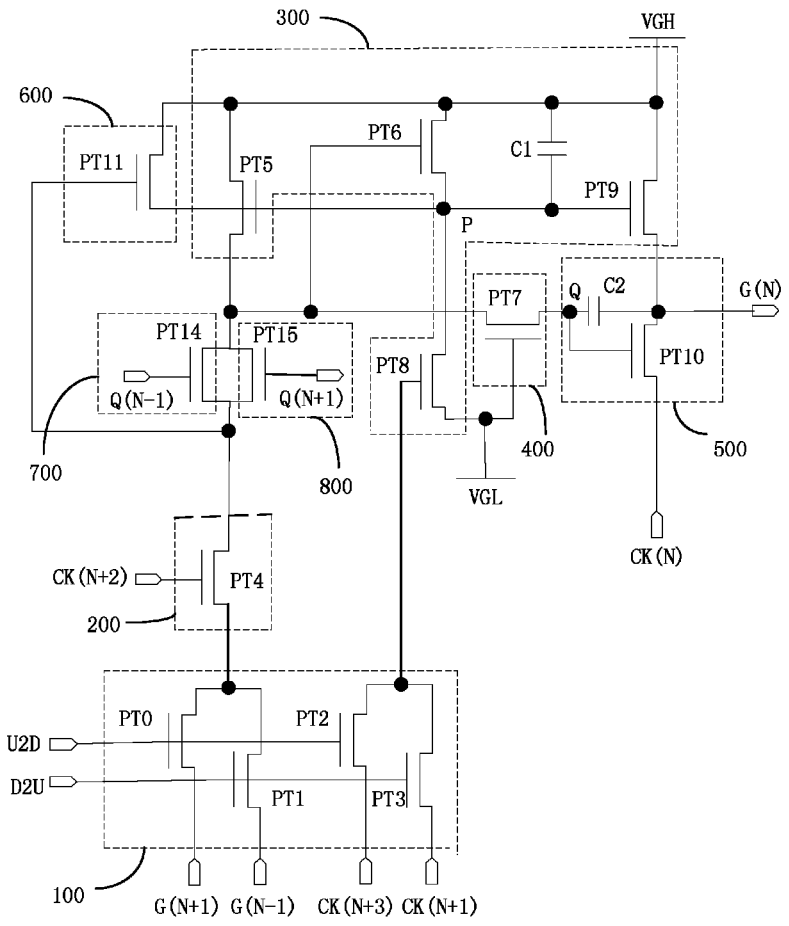
FIG. 7 is a schematic view of the scanning driving circuit in accordance with a fourth embodiment.

FIG. 7 is a schematic view of the scanning driving circuit in accordance with a fourth embodiment. The difference between this embodiment and the second embodiment resides in that: the first through the eighth controllable transistors (PT14, PT5, PT6, PT8-PT10, PT7, PT0-PT4 and PT15) are NMOS TFTs.

Figure 8:
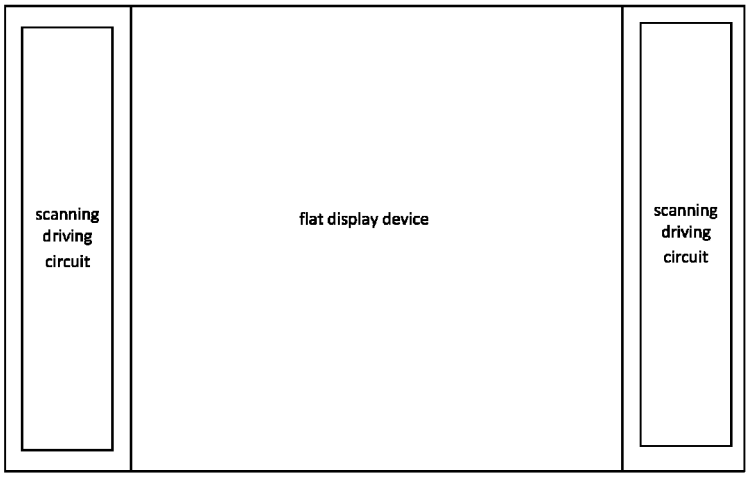
FIG. 8 is a schematic view of the flat display device in accordance with one embodiment.

FIG. 8 is a schematic view of the flat display device in accordance with one embodiment. The flat display device may be a LCD or OLED, which includes the above scanning driving circuit. The scanning driving circuit is arranged in a rim of the flat display device. For instance, the scanning driving circuit may be arranged at two ends of the flat display device. The scanning driving circuit may be any one of the scanning driving circuits in the present disclosure.

The scanning driving circuit controls the transfer of the scanning signals by the pull-up control signals Q(N−1) at the previous level and the pull-up control signals Q(N+1) at the next level to prevent the scanning driving circuit from being charged repeatedly during the non-operational period. In this way, the stability of the scanning driving circuit may be greatly enhanced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A scanning driving circuit, comprising:

a pull-up maintaining module is configured for receiving clock signals at a previous level, and is configured for pulling up a pull-down control signal node and for charging a pull-up control signals node in accordance with the received clock signals from the previous level;

a control module connects to the pull-up maintaining module for receiving pull-up control signals at the previous level and scanning driving signals at the previous level, and is configured for controlling the pull-up maintaining module in accordance with the pull-up control signals at the previous level and the scanning driving signals at the previous level;

an output module connects to the pull-up maintaining module and the control module for outputting the scanning driving signals to scanning lines;

scanning lines for transmitting the scanning driving signals to pixel cells;

wherein the scanning driving circuit further comprises:

a forward-backward scanning module for outputting forward scanning driving signals and backward scanning driving signals to drive the scanning driving circuit;

an input module connecting between the forward-backward scanning module and the control module, the input module is configured for receiving first next-level clock signals, and is configured for charging the pull-up control signal node by the received first next-level clock signals; and a processing module connecting the control module and the pull-up maintaining module, the processing module is configured for receiving the pull-up control signals at the previous level, and is configured for controlling the pull-up maintaining module in accordance with the pull-up control signals at the previous level.

2. The scanning driving circuit as claimed in claim 1 wherein the control module comprises a first controllable transistor, an input end of the first controllable transistor connects to the scanning driving signals at the previous level, a control end of the first controllable transistor connects to the pull-up control signals at the previous level, and an output end of the first controllable transistor connects to the pull-up maintaining module.

3. The scanning driving circuit as claimed in claim 1, wherein the pull-up maintaining module comprises a second controllable transistor, a third controllable transistor, a fourth controllable transistor, a fifth controllable transistor, and a first capacitor, an output end of the second controllable transistor connects to the output end of the first controllable transistor and a control end of the third controllable transistor, and a control end of the second controllable transistor connects to a control end of the fifth controllable transistor and an output end of the third controllable transistor, the input ends of the second controllable transistor, the third controllable transistor, and the fifth controllable transistor connect to a turn-on voltage end, the output end of the fifth controllable transistor connects to one scanning line and the output module, one end of the first capacitor connects to the input end of the fifth controllable transistor, and the other end of the first capacitor connects to the control end of the fifth controllable transistor, a control end of the fourth controllable transistor connects to the clock signals at the previous level, an input end of the fourth controllable transistor connects to the turn-off voltage end, and an output end of the fourth controllable transistor connects to the output end of the third controllable transistor.

4. The scanning driving circuit as claimed in claim 3, wherein the output module comprises a sixth controllable transistor and a second capacitor, a control end of the sixth controllable transistor connects to a first end of the second capacitor, and a second end of the second capacitor connects to the output end of the fifth controllable transistor, the scanning line, and an output end of the sixth controllable transistor, and an input end of the sixth controllable transistor connects to the clock signals at the current level.

5. The scanning driving circuit as claimed in claim 4, wherein the scanning driving circuit comprises a voltage regulator module for regulating the voltage and for preventing the pull-up maintaining module from leaking electricity, the voltage regulator module comprises a seventh controllable transistor, a control end of the seventh controllable transistor connects to the input end of the fourth controllable transistor and a turn-off voltage end, an input end of the seventh controllable transistor connects to the output end of the second controllable transistor, the output end of the first controllable transistor, and the control end of the third controllable transistor, and an output end of the seventh controllable transistor connects to the control end of the sixth controllable transistor and the first end of the second capacitor.

6. The scanning driving circuit as claimed in claim 5, wherein the scanning driving circuit further comprises a pull-up auxiliary module for avoiding electrical leakage when the pull-up maintaining module charges the pull-up control signal node of the output module, the pull-up auxiliary module comprises an eighth controllable transistor, a control end of the eighth controllable transistor connects to the input end of the first controllable transistor, an input end of the eighth controllable transistor connects to the input end of the second controllable transistor, the input end of the third controllable transistor, the input end of the fifth controllable transistor, and the turn-on voltage end, and an output end of the eighth controllable transistor connects to the control end of the second controllable transistor.

7. The scanning driving circuit as claimed in claim 6, wherein the forward-backward scanning module comprises a ninth controllable transistor, a tenth controllable transistor, an eleventh controllable transistor, and a twelfth controllable transistor, a control end of the ninth controllable transistor connects to a first scanning control voltage, an input end of the ninth controllable transistor connects to the scanning driving signals at the next level, and an output end of the ninth controllable transistor connects to the input module, a control end of the tenth controllable transistor connects to a second scanning control voltage, an input end of the tenth controllable transistor connects to the scanning driving signals at the previous level, and an output end of the tenth controllable transistor connects to the output end of the ninth controllable transistor, a control end of the eleventh controllable transistor connects to the first scanning control voltage, an input end of the eleventh controllable transistor connects to third next-level clock signals, and an output end of the eleventh controllable transistor connects to the pull-up maintaining module, a control end of the twelfth controllable transistor connects to the second scanning control voltage, an input end of the twelfth controllable transistor connects to the second next-level clock signals, and an output end of the twelfth controllable transistor connects to the output end of the eleventh controllable transistor; and the input module comprises a thirteenth controllable transistor, a control end of the thirteenth controllable transistor connects to the first next-level clock signals, an input end of the thirteenth controllable transistor connects to the output end of the first controllable transistor, and an output end of the thirteenth controllable transistor connects to the input end of the first controllable transistor of the control module; and the processing module comprises a fourteenth controllable transistor, a control end of the fourteenth controllable transistor connects to the pull-up control signals at the next level, an input end of the fourteenth controllable transistor connects to the input end of the first controllable transistor, and an output end of the fourteenth controllable transistor connects to the output end of the first controllable transistor and the output end of the second controllable transistor.

8. The scanning driving circuit as claimed in claim 7, wherein the first controllable transistor, the second controllable transistor, the third controllable transistor, the fourth controllable transistor, the fifth controllable transistor, the sixth controllable transistor, the seventh controllable transistor, the eighth controllable transistor, the ninth controllable transistor, the tenth controllable transistor, the eleventh controllable transistor, the twelfth controllable transistor, the thirteenth controllable transistor and the fourteenth controllable transistor are NMOS TFTs.

9. A flat display device, comprising:

at least one scanning driving circuit comprises:

a pull-up maintaining module is configured for receiving clock signals at a previous level, and is configured for pulling up a pull-down control signal node and for charging a pull-up control signals node in accordance with the received clock signals from the previous level;

a control module connects to the pull-up maintaining module for receiving pull-up control signals at the previous level and scanning driving signals at the previous level, and is configured for controlling the pull-up maintaining module in accordance with the pull-up control signals at the previous level and the scanning driving signals at the previous level;

an output module connects to the pull-up maintaining module and the control module for outputting the scanning driving signals to scanning lines;

scanning lines for transmitting the scanning driving signals to pixel cells;

wherein the scanning driving circuit further comprises:

a forward-backward scanning module for outputting forward scanning driving signals and backward scanning driving signals to drive the scanning driving circuit;

an input module connecting between the forward-backward scanning module and the control module, the input module is configured for receiving first next-level clock signals, and is configured for charging the pull-up control signal node by the received first next-level clock signals; and a processing module connecting the control module and the pull-up maintaining module, the processing module is configured for receiving the pull-up control signals at the previous level, and is configured for controlling the pull-up maintaining module in accordance with the pull-up control signals at the previous level.

10. The flat display device as claimed in claim 9, wherein the control module comprises a first controllable transistor, an input end of the first controllable transistor connects to the scanning driving signals at the previous level, a control end of the first controllable transistor connects to the pull-up control signals at the previous level, and an output end of the first controllable transistor connects to the pull-up maintaining module.

11. The flat display device as claimed in claim 10, wherein the pull-up maintaining module comprises a second controllable transistor, a third controllable transistor, a fourth controllable transistor, a fifth controllable transistor, and a first capacitor, an output end of the second controllable transistor connects to the output end of the first controllable transistor and a control end of the third controllable transistor, and a control end of the second controllable transistor connects to a control end of the fifth controllable transistor and an output end of the third controllable transistor, the input ends of the second controllable transistor, the third controllable transistor, and the fifth controllable transistor connect to a turn-on voltage end, the output end of the fifth controllable transistor connects to one scanning line and the output module, one end of the first capacitor connects to the input end of the fifth controllable transistor, and the other end of the first capacitor connects to the control end of the fifth controllable transistor, a control end of the fourth controllable transistor connects to the clock signals at the previous level, an input end of the fourth controllable transistor connects to the turn-off voltage end, and an output end of the fourth controllable transistor connects to the output end of the third controllable transistor.

12. The flat display device as claimed in claim 11, wherein the output module comprises a sixth controllable transistor and a second capacitor, a control end of the sixth controllable transistor connects to a first end of the second capacitor, and a second end of the second capacitor connects to the output end of the fifth controllable transistor, the scanning line, and an output end of the sixth controllable transistor, and an input end of the sixth controllable transistor connects to the clock signals at the current level.

13. The flat display device as claimed in claim 12, wherein the scanning driving circuit comprises a voltage regulator module for regulating the voltage and for preventing the pull-up maintaining module from leaking electricity, the voltage regulator module comprises a seventh controllable transistor, a control end of the seventh controllable transistor connects to the input end of the fourth controllable transistor and a turn-off voltage end, an input end of the seventh controllable transistor connects to the output end of the second controllable transistor, the output end of the first controllable transistor, and the control end of the third controllable transistor, and an output end of the seventh controllable transistor connects to the control end of the sixth controllable transistor and the first end of the second capacitor.

14. The flat display device as claimed in claim 13, wherein the scanning driving circuit further comprises a pull-up auxiliary module for avoiding electrical leakage when the pull-up maintaining module charges the pull-up control signal node of the output module, the pull-up auxiliary module comprises an eighth controllable transistor, a control end of the eighth controllable transistor connects to the input end of the first controllable transistor, an input end of the eighth controllable transistor connects to the input end of the second controllable transistor, the input end of the third controllable transistor, the input end of the fifth controllable transistor, and the turn-on voltage end, and an output end of the eighth controllable transistor connects to the control end of the second controllable transistor.

15. The flat display device as claimed in claim 14, wherein the forward-backward scanning module comprises a ninth controllable transistor, a tenth controllable transistor, an eleventh controllable transistor, and a twelfth controllable transistor, a control end of the ninth controllable transistor connects to a first scanning control voltage, an input end of the ninth controllable transistor connects to the scanning driving signals at the next level, and an output end of the ninth controllable transistor connects to the input module, a control end of the tenth controllable transistor connects to a second scanning control voltage, an input end of the tenth controllable transistor connects to the scanning driving signals at the previous level, and an output end of the tenth controllable transistor connects to the output end of the ninth controllable transistor, a control end of the eleventh controllable transistor connects to the first scanning control voltage, an input end of the eleventh controllable transistor connects to third next-level clock signals, and an output end of the eleventh controllable transistor connects to the pull-up maintaining module, a control end of the twelfth controllable transistor connects to the second scanning control voltage, an input end of the twelfth controllable transistor connects to the second next-level clock signals, and an output end of the twelfth controllable transistor connects to the output end of the eleventh controllable transistor;

the input module comprises a thirteenth controllable transistor, a control end of the thirteenth controllable transistor connects to the first next-level clock signals, an input end of the thirteenth controllable transistor connects to the output end of the first controllable transistor, and an output end of the thirteenth controllable transistor connects to the input end of the first controllable transistor of the control module; and the processing module comprises a fourteenth controllable transistor, a control end of the fourteenth controllable transistor connects to the pull-up control signals at the next level, an input end of the fourteenth controllable transistor connects to the input end of the first controllable transistor, and an output end of the fourteenth controllable transistor connects to the output end of the first controllable transistor and the output end of the second controllable transistor.

16. The flat display device as claimed in claim 15, herein the first controllable transistor, the second controllable transistor, the third controllable transistor, the fourth controllable transistor, the fifth controllable transistor, the sixth controllable transistor, the seventh controllable transistor, the eighth controllable transistor, the ninth controllable transistor, the tenth controllable transistor, the eleventh controllable transistor, the twelfth controllable transistor, the thirteenth controllable transistor and the fourteenth controllable transistor are NMOS TFTs.

* * * * *